US010405570B2

(12) United States Patent
Nagai et al.

(10) Patent No.: US 10,405,570 B2
(45) Date of Patent: Sep. 10, 2019

(54) METHOD OF MANUFACTURING TOBACCO RAW MATERIAL AND ORAL TOBACCO PRODUCT

(71) Applicant: JAPAN TOBACCO INC., Tokyo (JP)

(72) Inventors: Atsushi Nagai, Tokyo (JP); Kei Kobayashi, Tokyo (JP); Hiroyuki Chida, Tokyo (JP); Kazuo Mori, Tokyo (JP); Hiroshi Otaki, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 155 days.

(21) Appl. No.: 15/447,921

(22) Filed: Mar. 2, 2017

(65) Prior Publication Data

US 2017/0172199 A1 Jun. 22, 2017

Related U.S. Application Data

(63) Continuation of application No. PCT/JP2015/076028, filed on Sep. 14, 2015.

(30) Foreign Application Priority Data

Sep. 18, 2014 (JP) ..... 2014-190245

(51) Int. Cl.
*A24B 3/04* (2006.01)
*A24B 1/02* (2006.01)
(Continued)

(52) U.S. Cl.
CPC ..... *A24B 3/04* (2013.01); *A24B 1/02* (2013.01); *A24B 3/12* (2013.01); *A24B 13/00* (2013.01); *A24B 15/10* (2013.01)

(58) Field of Classification Search
None
See application file for complete search history.

(56) References Cited

U.S. PATENT DOCUMENTS

2010/0154810 A1 6/2010 Williams
2012/0234334 A1 9/2012 Chen et al.

FOREIGN PATENT DOCUMENTS

EP 2 957 185 A1 12/2015
JP 3922985 B2 5/2007
(Continued)

OTHER PUBLICATIONS

English translation of International Preliminary Report on Patentability and Written Opinion dated Mar. 30, 2017, in PCT International Application No. PCT/JP2015/076028.
(Continued)

*Primary Examiner* — Phu H Nguyen
(74) *Attorney, Agent, or Firm* — Birch, Stewart, Kolasch & Birch, LLP

(57) ABSTRACT

Provided is a method of manufacturing a tobacco raw material in which the green color of the tobacco raw material is maintained and a browning-involved enzyme included in tobacco leaves is deactivated. Specifically, a method of manufacturing a tobacco raw material is provided that includes a step for heating a tobacco leaf material, which has an a* value of 1.0 or less, the a* value being expressed by the L*a*b* method, and which has a moisture content of 8 wt % or less, at a temperature of 75° C. or higher and under a humidity-controlled environment so that the a* value is 1.0 or less and the content of the browning-involved enzyme is 0.1 U/g or less.

4 Claims, 4 Drawing Sheets

(a)

(b)

(51) Int. Cl.

| | |
|---|---|
| ***A24B 3/12*** | (2006.01) |
| ***A24B 15/10*** | (2006.01) |
| ***A24B 13/00*** | (2006.01) |

(56) References Cited

FOREIGN PATENT DOCUMENTS

| | | | | |
|---|---|---|---|---|
| JP | 2007-26771 | A | 10/2007 | |
| JP | 2009-508523 | A | 3/2009 | |
| JP | 2014-511672 | A | 5/2014 | |
| WO | WO 2007/037962 | A1 | 4/2007 | |
| WO | WO 2014/156431 | A1 | 10/2014 | |
| WO | WO-2014156431 | A1 * | 10/2014 | ..... A24B 13/00 |

OTHER PUBLICATIONS

International Search Report; issued in PCT/JP2015/076028 (PCT/ISA/210), dated Nov. 10, 2015.
Kawada el al., "Bulletin of Morioka Tobacco Experiment Station", 1980, vol. 14, pp. 17-30, with its English abstract (Sumary).
Written Opinion of the International Searching Authority. issued in PCT/JP2015/076028 (PCT/ISA/237), dated Nov. 10, 2015.
Extended European Search Report dated Feb. 20, 2018, in European Patent Application No. 15842178.4.

* cited by examiner (b)

(a)

(b)

(a)

METHOD OF MANUFACTURING TOBACCO RAW MATERIAL AND ORAL TOBACCO PRODUCT

CROSS REFERENCE TO RELATED APPLICATIONS:

This application is a Continuation of PCT International Application No. PCT/JP2015/076028, filed on Sep. 14, 2015, which claims priority under 35 U.S.C. 119(a) to Patent Application No. 2014-190245, filed in the Japan on Sep. 18, 2014, all of which are hereby expressly incorporated by reference into the present application.

TECHNICAL FIELD

The present invention relates to a method for manufacturing a tobacco material.

BACKGROUND ART

Oral tobacco products such as snus are obtained by accommodating a tobacco material in a packaging material formed out of a material such as a nonwoven fabric. A user utilizes this oral tobacco product by placing same inside the oral cavity.

Given that the oral tobacco product is used in this manner, undesirable components contained in the tobacco material may seep out of the tobacco material into the oral cavity of the user. In this regard, Patent document 1 for instance discloses a technology for lowering the amount of nitrosamine contained in a tobacco material during the manufacturing of an oral tobacco product.

Patent document 1 discloses the feature of drying air-dried, yellowed tobacco leaves through a natural drying step and a controlled drying step, to reduce nitrite nitrogen and nitrosamine in the tobacco material.

Patent document 2 discloses an invention pertaining to a display mechanism of a drying room that is used for drying of flue-cured variety tobacco. Regarding drying of flue-cured variety tobacco, Patent document 2 discloses the feature of raising the temperature from 38° C. at an initial stage up to 68° C. ultimately, and setting a yellowing period to about 95 to 75% RH and a drying period of tobacco stems to about 50 to 20% RH.

Unlike the foregoing art, Patent document 3 discloses art relating to a smokeless tobacco composition, and mentions a coloring agent as being included in the composition.

Known drying methods of tobacco leaves include fire-drying of green wrappers that are used mainly as a material for cigars (Non-patent document 1). Non-patent document 1 discloses a standard temperature-humidity operation diagram regarding drying of tobacco leaves before leaf tobacco turns yellow (yellowing) (fermentation period: dry bulb of 35° C., wet bulb of 29 degrees C., 10 to 14 hours; color and gloss fixing period: dry bulb of 45 to 50° C., wet bulb of 32 to 34° C., 20 to 26 hours; tobacco stem drying period: dry bulb of 55 to 70° C., wet bulb of 37° C., 30 to 36 hours). Non-patent document 1 indicates that in the product obtained in accordance with the above drying method the yield of a green wrapper article was 33.5%.

CITATION LIST

Patent Document

[Patent document 1] Japanese Patent No. 3922985
[Patent document 2] Japanese Patent Application Publication No. 2007-267712
[Patent document 3] Japanese Translation of PCT Application No. 2009-508523

Non-Patent Document

[Non-patent document 1] Bulletin of Morioka Tobacco Experiment Station, 14, 17-30, 1980

SUMMARY OF INVENTION

Technical Problem

In the method disclosed in Non-patent document 1, tobacco leaves are dried in a state where green color is maintained, but it was found that when a tobacco material obtained in accordance with that method was extracted with water, the color of the resulting extract was brown. An extract having such a dark color may leave an undesirable impression to a user of the tobacco product in which the tobacco material is used.

In the method disclosed in Patent document 1, a drying treatment (microwave or controlled drying) is carried out after yellowing of the tobacco leaves. In the method disclosed in Patent document 1, specifically, the timing of the treatment of harvested tobacco leaves is disclosed to be a point in time at least after the tobacco is no longer in a green state.

In the method disclosed in Patent document 2, the drying treatment is conducted after yellowing period of tobacco leaves, and hence it is deemed that the color of the treated tobacco leaves are yellow.

In the light of the above, it is deemed that the green color of the tobacco materials obtained in accordance with the methods disclosed in Patent document 1 and 2 is not preserved in either case. Extracts that enter into the oral cavity are expected to take on a dark color in cases where an oral tobacco product uses a tobacco material obtained by performing a drying treatment on yellowed tobacco leaves, as in the method disclosed in Patent document 1, or uses a tobacco material that undergoes yellowing after drying, as in the tobacco material having gone through the method disclosed in Patent document 2.

As indicated above, Patent document 3 illustrates a coloring agent as a material that is incorporated into a smokeless tobacco composition. Although such a technique allows imparting color to a smokeless tobacco composition, the coloring action was due to the coloring agent included in the composition.

Accordingly, it is an object of the present invention to provide a method for manufacturing a tobacco material in which the green color of the tobacco material is maintained, without using a coloring agent, and in which an enzyme eliciting enzymatic browning in the tobacco material is inactivated, in order to lighten the color of an extract of the tobacco material resulting from extraction with water as a solvent.

Solution to Problem

As a result of diligent research, the inventors found that the above problems can be solved by subjecting a specific tobacco leaf material to a specific heating treatment, as a result of which the obtained tobacco material takes on a green color, and an enzyme eliciting enzymatic browning contained in the tobacco leaves becomes inactivated, whereby green color is retained and an extract obtained through extraction of the tobacco material with water exhibits a light color, and arrived at the present invention on the basis of these findings.

Specifically, the present invention is as follows.

[1] A method for manufacturing a tobacco material, having a step of heating a tobacco leaf material having an a* value of 1.0 or less expressed according to the L*a*b* method and having a moisture content of 8 weight % or less, at a temperature of 75° C. or higher and in a humidity-controlled environment, in such a manner that the a* value is 1.0 or less and activity of an enzyme eliciting enzymatic browning is 0.1 U/g or less.

[2] The manufacturing method of [1], wherein the humidity-controlled environment is an environment at 3% RH to 60% RH.

[3] The manufacturing method of [1] or [2], wherein the humidity-controlled environment is an environment in which relative humidity is kept substantially constant between 3% RH and 60% RH.

[4] The manufacturing method of any one of [1] to [3], wherein the temperature in the step of heating is 99° C. or lower.

[5] An oral tobacco product that uses the tobacco material obtained in accordance with the manufacturing method of any one of [1] to [4].

Effects of Invention

In the present invention the color of the extract that enters the oral cavity of the user when the latter utilizes the obtained tobacco material as an oral tobacco product does not become dark-colored. Further, the tobacco material of the present invention retains a green color.

DESCRIPTION OF EMBODIMENTS

Figure 1:
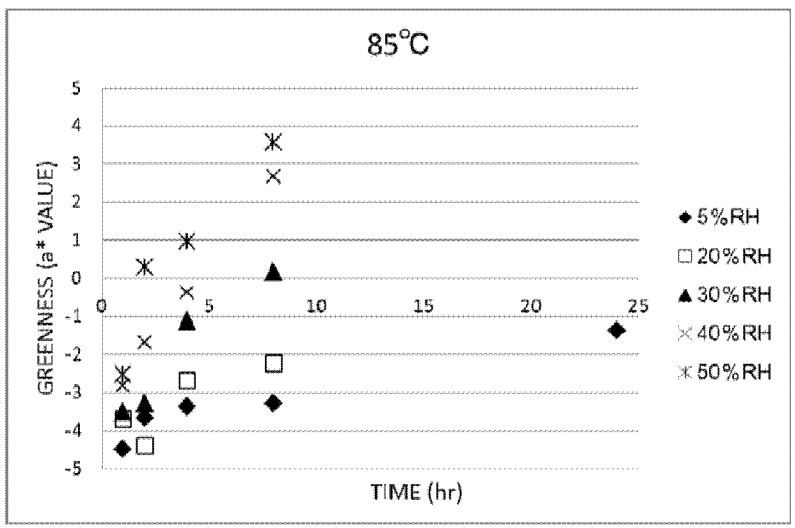
FIG. 1 is a diagram illustrating greenness (a* value) after a respective heating time has elapsed, for each relative humidity, in a tobacco material obtained in Example 2 (heating temperature (a): 78° C., (b): 85° C.).
Figure 1:
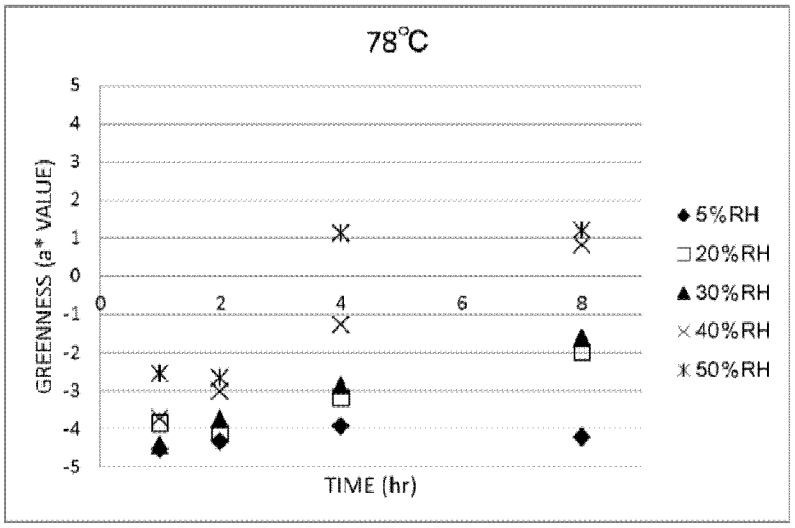

The invention is described in detail below by way of embodiments, examples and the like. However the invention is not limited to the following embodiments and examples, and may be carried out modified in arbitrary ways without departing from the spirit and scope of the invention.

<Tobacco Leaf Material>

The type of tobacco serving as the tobacco material used in the oral tobacco product of the present invention is not particularly limited, and examples thereof include for instance varieties of the genus *Nicotiana*, such as flue-cured and Burley varieties of *Nicotiana tabacum*, as well as brasilia varieties of *Nicotiana rustica*.

In the manufacturing method of the present invention, the tobacco leaf material that is used as a tobacco material is a tobacco leaf material having an a* value, expressed according to the L*a*b* method, of 1.0 or less, and having a moisture content of 8 weight % or less.

Such a tobacco leaf material can be obtained in accordance with a known method. For instance, the method disclosed in Non-patent document 1 above, specifically, the conditions set out in the standard temperature-humidity operation diagram described in Non-patent document 1, can be resorted to herein.

In a specific implementation, firstly drying is performed (fermentation period) for 3 to 24 hours at 20 to 40° C., at a relative humidity (which in some instances may be expressed in the form of the difference between "dry bulb temperature" and "wet bulb temperature") of 40 to 80% RH (hereafter, "% RH" will be used as units of relative humidity); thereafter, drying is performed for 24 to 72 hours at 40 to 55° C. and relative humidity of 40 to 70% RH (color and gloss fixing period: leaves dry); and thereafter, drying is performed for 0 to 120 hours at 60 to 70° C. and relative humidity of 5 to 30% RH (tobacco stem drying period: drying up to the tobacco stem). If such a method is resorted to, the respective steps may be performed separately or continuously. A continuous process is preferable herein in terms of preserving the green color of the tobacco leaf material.

Drying over the tobacco stem drying period may be omitted. In such a case, the drying time of the color and gloss fixing period becomes longer, and the moisture content of the tobacco leaf material that is obtained are sufficiently reduced down to at least 8 weight % or less.

When the moisture content of the tobacco leaf material used in the manufacturing method of the present invention exceeds 8 weight %, the green color of the tobacco leaf material fades significantly in a subsequent heating step.

In the present invention, the term "tobacco leaf material" denotes a material that is subjected to the manufacturing method of the present invention, but which does not undergo the specific heating step described below. The term "tobacco material" denotes a material obtained as a result of the specific heating step described below.

For instance tobacco leaves after harvesting but before turning yellow can be used as the tobacco leaf material having an a* value of 1.0 or less expressed according to the L*a*b* method.

The language "to turn yellow" signifies that the greater part, for instance 60% or more, or even 90% or more of the surface area of the harvested leaves change color to a degree where the a* value expressed according to the L*a*b* method takes on a value larger than 1.0. The (green) pigment present in tobacco leaves decreases after the leaves have been harvested, causing the tobacco leaves to turn yellow. The a* value of the tobacco leaves after harvesting ranges ordinarily from about −9 to about −1.5.

The tobacco leaf material used in the manufacturing method of the present invention is not particularly limited so long as it satisfies the above conditions. Besides the method illustrated in Non-patent document 1, a procedure may be resorted to wherein after harvesting of the tobacco leaves, the portion of the leaves from which the tobacco stem has been removed may be subjected to a treatment process. Alternatively, the tobacco leaves after harvesting may be subjected to removal of moisture by pressing or the like, and be then subjected to a treatment process. Further, the tobacco leaves after harvesting may be refrigerated or frozen and stored, and be subsequently subjected to a treatment process.

The smaller the a* value according to the L*a*b* method, the stronger is the green color. The green color can be made stronger by harvesting the tobacco leaves at an earlier date than when the tobacco leaves are to be used in ordinary cigarettes. A lower limit of −20 or more for the range in the a* value is suitable herein from the standpoint of securing the green color of the tobacco material. The greenness (a* value) is suitably −2 or less in cases where the green color of the tobacco material is to be made stronger.

The a* value of the tobacco leaves prior to being treated is measured as follows.

The color at 20 sites on the surface of tobacco leaves is measured using a spectrophotometer (KONICA MINOLTA/CM-3500d, by Konica Minolta Holdings, Inc.). Color definitions are expressed according to the L*a*b* color system used by the Commission International de l'Eclairage (CIE) and JIS.

Figure 4:
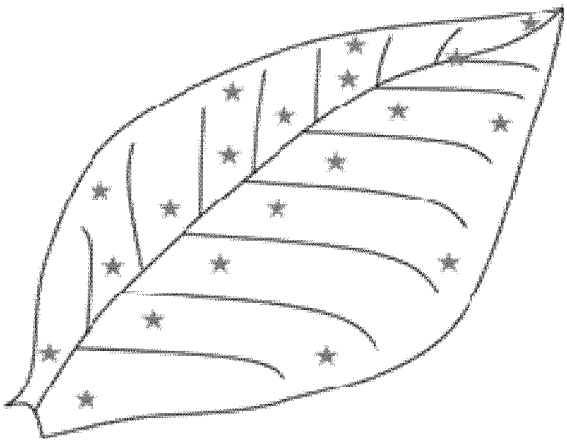
FIG. 4 is a diagram illustrating an example of points (stars) selected for colorimetry (a* value) of tobacco leaves (tobacco leaf material) prior to a being treated.

The 20 sites on the surface of the tobacco leaves are uniformly selected at, for example, the center and periphery of the leaves, as indicated by stars in FIG. 4.

The color measurement operation involves irradiating standard light (Standard Illuminant D65 for colorimetry; reference light in CIE and ISO) and measuring the reflected light (reflection colorimetry/specular component excluded (SCE) method), to obtain numerical values. A smaller a* value obtained upon measuring the tobacco leaves under these conditions may be regarded as indicating a greener color.

<Heating Step>

The manufacturing method of the present invention has a step of heating the above tobacco leaf material at a temperature of 75° C. or higher and in a humidity-controlled environment, in such a manner that the a* value is 1.0 or less and the activity of enzyme eliciting enzymatic browning (PPO) is 0.1 U/g or less.

As a result of such heating, polyphenyl oxidase (PPO) contained in the tobacco material that is obtained becomes inactivated, and a state is preserved where the a* value of the tobacco material is 1 or less, i.e. green color is retained.

In one implementation of heating, the heating temperature can be set for instance to 75° C. or higher, or alternatively to 80° C. or higher. In yet another implementation the temperature can be set to 85° C. or higher. The upper limit of heating temperature includes for instance 99° C. or lower, or 90° C. or lower in another implementation. The heating temperature may be kept substantially constant, within the above ranges, during the heating step.

The relative humidity during heating may be set to lie in the range of 3% RH to 60% RH.

The relative humidity during heating may be kept substantially constant, within the above ranges of relative humidity.

The feature of relative humidity being kept substantially constant denotes herein a state where the relative humidity is maintained continuously within a fluctuation range of about ±10%.

In one implementation, the heating time may be set to about 1 hour to 3 days.

The heating time may be set to be longer, to reduce relative humidity (for instance 20% or lower), in terms of reliably inactivating PPO activity, or may be set to be shorter, to increase the relative humidity (for instance, in excess of 30%), in terms of keeping the a* value low, for a same heating temperature condition.

Concrete implementations values of heating temperature, relative humidity and heating time include for instance the following.

In a case where the heating temperature is set to lie in the range of 75° C. to less than 80° C. and the relative humidity in the range of 3% RH to 20% RH, the heating time can be set to 48 hours or longer. Meanwhile, the upper limit of the heating time in this case can be set to 96 hours or shorter.

In a case where the heating temperature is set to about 80 to 85° C. and the relative humidity to 3% RH to less than 10% RH, the heating time can be 24 hours or longer. Meanwhile, the upper limit of the heating time in this case can be 96 hours or shorter.

In a case where the heating temperature is set to about 80 to 85° C. and the relative humidity to 10% RH to less than 40% RH, the heating time can be about 4 to 18 hours.

In a case where the heating temperature is set to about 80 to 85° C. and the relative humidity to 40% RH to 60% RH, the heating time can be about 1 to 2 hours.

Implementations other than the above are not particularly limited and can be adopted so long as the a* value of the obtained tobacco material is 1.0 or less and PPO activity is 0.1 U/g or less.

A thermo-hygrostat can for instance be used herein as a device that allows performing heating in such a manner that the a* value of the obtained tobacco material is 1.0 or less and PPO activity is 0.1 U/g or less. Specific examples include for instance a thermo-hygrostat (PR-3KPH) by ESPEC Corp.

The a* value of the tobacco material obtained through the manufacturing method of the present invention can be measured by crushing a tobacco material, having been dried to a moisture content of 3 to 5 weight %, down to 1 to 2 mm (mesh) using a grinder, and by measuring the color of the crushed sample using a spectrophotometer. Color definitions are expressed according to the L*a*b* color system, similarly to the above-described color measurement of the tobacco leaves.

In the color measurement operation, numerical values can be obtained by charging a sample powder into a glass vessel, to a layer thickness of 1 cm, directing standard light (Standard Illuminant D65 for colorimetry; reference light in CIE and ISO) at the sample from the bottom of the vessel, and measuring the reflected light (reflection colorimetry/specular component excluded (SCE) method).

The color of an extract of the tobacco material obtained according to the manufacturing method of the present invention, using water as the extraction solvent, exhibits an absorbance at the 420 nm wavelength (also notated as "ABS 420 nm") of 1.0 or less.

The above absorbance is ordinarily 0.2 or more if the tobacco material is not subjected to the steps of the manufacturing method of the present invention.

Extraction with water is accomplished in accordance with the following procedure.

Herein 1 part by weight of tobacco material obtained by lowering the moisture content to 5 weight % or less and by crushing is weighed and added to 25 parts by weight of water at 22° C. Shaking extraction is then carried out for about 10 minutes. The resulting extract is left to stand at the same temperature for about 20 minutes, followed by filtering using a 0.20 μm membrane filter. The filtered solution is diluted two-fold with water and the 420 nm wavelength absorbance is measured using an absorption spectrophotometer. Absorbance is measured in the present invention over an optical path of 1 cm.

In the present invention, the numerical value of absorbance under the above conditions is also referred to as "degree of browning". A larger numerical value of the latter entails a higher degree of brownness of the extract. In the present invention, the terms brown and brown-colored are synonymous.

The degree of browning can be adjusted by varying the heating treatment temperature and time for lowering PPO activity in the method for manufacturing a tobacco material described above.

To curtail increases in the degree of browning, specifically, it is effective to raise the temperature of the heating treatment and/or to prolong the time of the heating treatment, in order to reduce PPO activity. The temperature and time of the heating treatment are adjusted in accordance with the relative humidity, from the viewpoint of preserving the greenness of the tobacco material.

The enzyme activity value of the tobacco material can be obtained by adding a solution of enzyme protein extracted from a sample and a potassium phosphate buffer solution (pH 6.0) to the cell of an absorption spectrophotometer, with mixing of the solutions, and by adding to the resulting mixture a 10 mM pyrocatechol solution as a substrate, followed by measurement of the increase in the 420 nm wavelength absorbance with respect to a reference, at 40° C. For instance a solution obtained through mixing of a potassium phosphate buffer solution instead of the enzyme protein solution can be used as the reference. As the extraction conditions there is used a method identical to that in the examples described below.

The amount of enzyme that raises the absorbance of the sample (ΔABS) by 0.01 over a period of 1 minute, after subtracting the increment in absorbance derived from the reference, is defined as 1 U.

In the method for manufacturing a tobacco material of the present invention, the tobacco material is obtained as a result of a process that involves heating a specific tobacco leaf material under specific conditions, as described above. Freeze-drying alone would suffice herein in terms of just increasing the greenness (a* value) of the tobacco material after drying. However, the tobacco material obtained by freeze-drying alone suffers a marked drop in quality after drying, and undergoes browning as it absorbs moisture after drying.

Extracts of tobacco materials that have only been freeze-dried exhibit pronounced browning. The requirements that the tobacco material should be green in color and that an extract thereof should exhibit a low degree of browning, which are the effects of the present invention, are not satisfied in such a case.

<Oral Tobacco Product>

The tobacco material obtained in accordance with the manufacturing method of the present invention can be used for instance as an oral tobacco product. Examples of the oral tobacco product include snus, gum, chewing tobacco, snuff, compressed tobacco (tablets, sticks and the like) and edible films.

In a case for instance where the oral tobacco product of the present invention is snus, the latter can be obtained by filling the above-described tobacco material, in accordance with a known method, into a packaging material that uses for instance a starting material such as a nonwoven fabric. For instance, snus can be obtained by filling the tobacco material while adjusting the amount of the latter, and by sealing the whole for instance through heat sealing.

The packaging material that can be used is not particularly limited, but a cellulosic nonwoven fabric or the like is preferably used herein.

In a case where the raw material of the present invention is to be made into an oral tobacco product, and more specifically into gum, the latter is obtained by mixing the above tobacco material used in the present invention with a known gum base, in accordance with a known method. Chewing tobacco and snuff, and compressed tobacco as well, can be obtained in accordance with known methods, but utilizing herein the tobacco material that is used in the present invention. Edible films as well can be obtained using known materials and in accordance with known methods, but utilizing herein the above tobacco material that is used in the present invention.

In a case where the tobacco material of the present invention is used as an oral tobacco product, the proportion of the tobacco material obtained through the manufacturing method of the present invention can be adjusted as appropriate, but is preferably as high as possible, preferably of 40 weight % or more, more preferably 60 weight % or more, yet more preferably 80 weight % or more, even more preferably 98 weight % or more, and particularly preferably 100 weight %, with respect to the total amount of the tobacco material.

If the oral tobacco product that uses the tobacco material of the present invention is to contain tobacco materials other than the above specific tobacco material, then materials that do not detract from the effect of the present invention are used as such other tobacco materials.

The degree of browning of the extract of the tobacco material of the present invention is low. This is accordingly expected to allow suppressing seeping of brown color to the packaging material in which the article that uses the tobacco material is packed. Further, the color of the tobacco material is kept green.

EXAMPLES

The present invention will be explained next more specifically by way of examples, but the invention is not limited to the examples below, so long as the invention does not go beyond the gist thereof.

Reference Example 1

Lower leaves of leaf tobacco of domestic Burley were harvested and were placed in a mechanical drying room, where the leaves were dried in a controlled atmosphere. The controlled atmosphere will be explained next.

Firstly, the harvested leaves were kept for 12 hours at a dry bulb temperature of 36° C. and a wet bulb temperature of 29° C. (75% RH). Next, the mesophyll was dried for 24 hours at a dry bulb temperature of 45° C. and a wet bulb temperature of 32° C. (relative humidity 42%). Lastly, the entirety of the tobacco leaves, including the tobacco stem, was dried for 36 hours in an atmosphere at a dry bulb temperature of 68° C. and a wet bulb temperature of 40° C. (20% RH), to yield a tobacco leaf material. The above drying step conforms to the drying method disclosed in Non-patent document 1.

The ABS 420 nm of a water extract of this tobacco leaf material was 1.82, and the PPO activity in the tobacco leaf material was 0.43 U/g.

Example 1

In contrast to the reference example, in Example 1 according to the manufacturing method of the present invention a tobacco leaf material was obtained by firstly keeping a dry bulb temperature of 36° C. and a wet bulb temperature of 29° C. (75% RH) for 12 hours in accordance with the method disclosed in Non-patent document 1, drying next the mesophyll for 24 hours at a dry bulb temperature of 45° C. and a wet bulb temperature of 32° C. (relative humidity 42%), and drying then the leaf veins for 36 hours in an atmosphere at a dry bulb temperature of 68° C. and a wet bulb temperature of 40° C. (20% RH). The a* value herein was −5.966 and the moisture content was 6.36% weight%. After drying, the tobacco leaf material was heated for 60 minutes in a humidity-conditioned atmosphere at a dry bulb temperature of 85° C. and a wet bulb temperature of 69° C. (50% RH), to yield a tobacco material. The obtained tobacco material had an a* value of −2.5 and PPO activity of 0.016 U/g. The ABS 420 nm of a water extract was 0.67.

Both the tobacco leaf material and tobacco material obtained in Reference example 1 and in Example 1 exhibited green color, and the colorimetric value (a* value) measured using a spectrophotometer was 1.0 or less in both cases.

However, the ABS 420 nm of the water extract of the tobacco leaf material obtained in Reference example 1 was 1.82, indicative of browning.

It was thus found that in terms of merely obtaining a green tobacco leaf material, a conventional technology such as the one described in Non-patent document 1 can be resorted to, but the color of the extracted product upon soaking with water exhibited intense browning.

(Measurement of Enzyme Activity)

Measurement of the PPO activity of the tobacco leaf material and the tobacco material was performed as follows. A sample of 1 g of for instance crushed tobacco leaf material was weighed in a 100 mL vial. To the latter there was added 50 mL of a 20 mM potassium phosphate buffer (pH 6.0); the resulting sample was homogenized for 2 minutes in an ice-cooled environment, and the sample was further ultrasonified for 30 minutes in an ice-cooled environment.

Thereafter, the resulting extracted product was filtered using a 0.2 μm membrane filter (membrane material: cellulose acetate). The resulting filtrate was a crude enzyme solution used for enzyme activity measurement. The PPO activity measurement was conducted using the enzyme solution, reaction buffer and substrate solution described above. The procedure for activity measurement is as follows.

Herein 900 μL of a 100 mM potassium phosphate buffer (pH 6.0) was mixed with 100 μL of crude enzyme solution, and the temperature of the mixture was adjusted to 40° C. Then 1000 μL of a 10 mM pyrocatechol solution were mixed with the above mixture, and the rate of increase of absorbance at 420 nm was measured using a spectrophotometer. As a control there was used 1000 μL of a 100 mM potassium phosphate buffer (pH 6.0) having no enzyme solution mixed thereinto. The amount of enzyme that causes the absorbance (ΔABS) of the crude enzyme solution to increase by 0.01 over 1 minute was defined as 1 U.

(Measurement of a* Value)

The color in the outer appearance of the tobacco leaf material and the tobacco material was measured in accordance with the following procedure.

A tobacco leaf material or tobacco material having been dried down to a moisture content of 3 to 5% was crushed down to 1 to 2 mm (mesh) using a grinder (MiniBlender, by Melitta Japan, Ltd. (Tokyo, Japan)), and the color of the crushed sample was measured using a spectrophotometer (KONICA MINOLTA/CM-3500d, by Konica Minolta Holdings, Inc.). The color definitions were expressed according to the L*a*b* color system used by the Commission International de l'Eclairage (CIE) and JIS.

The color measurement operation involved obtaining numerical values by charging a sample powder into a glass vessel, to a layer thickness of 1 cm, directing standard light (Standard Illuminant D65 for colorimetry; reference light in CIE and ISO) at the sample from the bottom of the vessel, and measuring the reflected light (reflection colorimetry/specular component excluded (SCE) method).

The degrees of greenness (a* value) of tobacco leaves (frozen product) after harvesting but prior to drying, of the Burley variety, flue-cured variety and Nicotiana rustica, which are ordinary tobacco leaves, were as follows: Burley variety: −2.1±0.3, flue-cured variety: −2.5±0.6, Nicotiana rustica: −4.6±0.5.

(Measurement of ABS 420 nm)

The degree of browning of extracts of the tobacco leaf material and of the tobacco material was measured in accordance with the method below. For instance a material (tobacco leaves) dried to a moisture content of 5% or less is weighed out in an amount of 0.4 g, then 10 mL of water is added, and shaking extraction is carried out for 10 minutes at 22° C. After shaking, the extract was left to stand at 22° C. for 20 minutes, and was then filtered with a 0.20 μm pore diameter membrane filter (Whatman PVDF membrane, by GE Healthcare UK Ltd. (Buckinghamshire, UK)). The filtered solution was diluted two-fold with water and the 420 nm wavelength absorbance was measured using an absorption spectrophotometer.

Example 2

A tobacco leaf material obtained by performing a drying treatment in accordance with the same method as in Reference example 1 was used herein, the relative humidity was adjusted to a specific value, in an environment at a heating temperature of 78° C. or 85° C., and then there were measured the changes in physical properties (a* value, ABS 420 nm, PPO activity) of the tobacco leaf material (tobacco material) as heating time went by.

Specifically, the relative humidity was adjusted to 5% RH, 20% RH, 30% RH, 40% RH or 50% RH, and the various physical properties were measured upon elapsing of 1 hour, 2 hours, 4 hours, 8 hours (,24 hours) of heating time.

Figure 2:
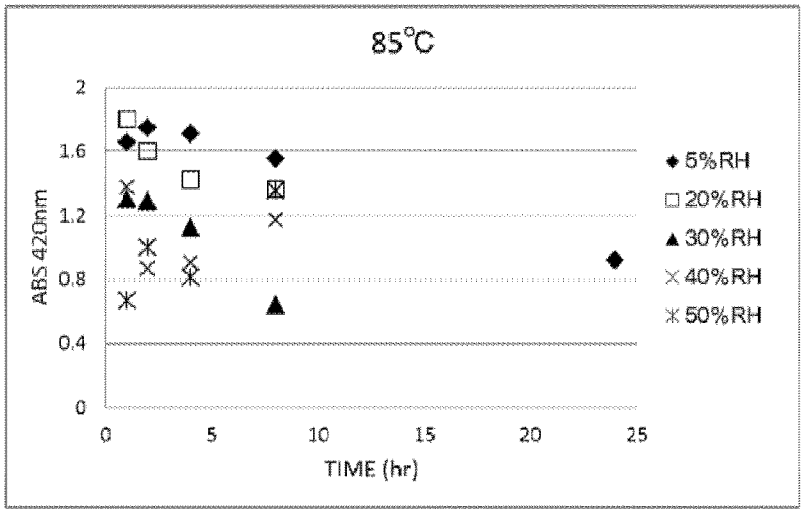
FIG. 2 is a diagram illustrating ABS 420 nm after a respective heating time has elapsed, for each relative humidity, in the tobacco material obtained in Example 2 (heating temperature (a): 78° C., (b): 85° C.).
Figure 2:
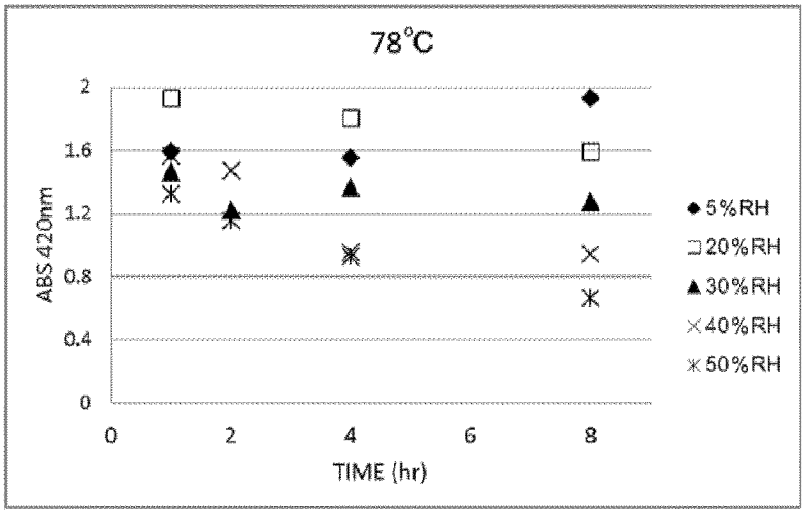
Figure 3:
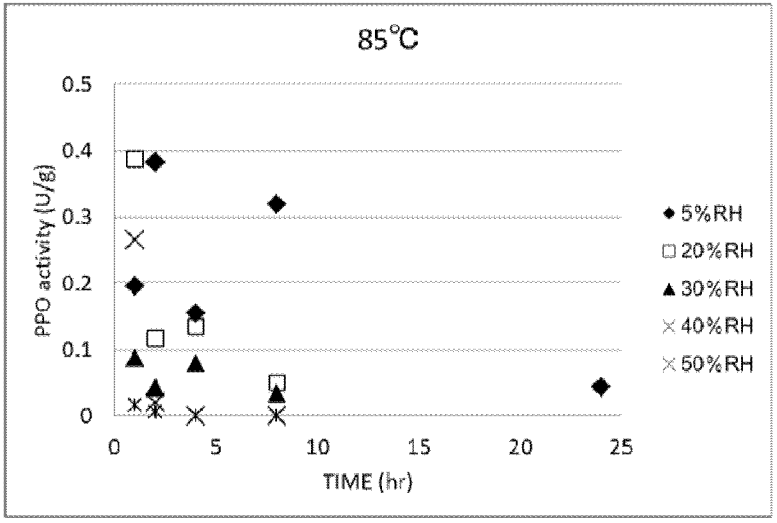
FIG. 3 is a diagram illustrating PPO activity after a respective heating time has elapsed, for each relative humidity, in the tobacco material obtained in Example 2 (heating temperature (a): 78° C., (b): 85° C.).
Figure 3:
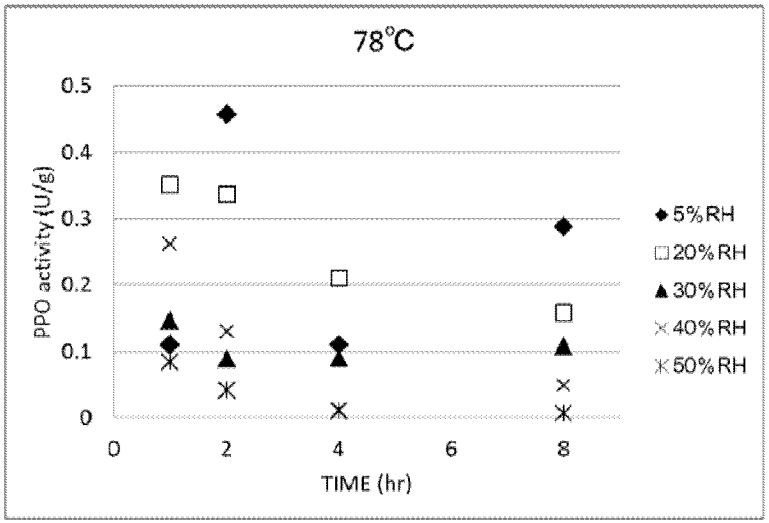

The results are illustrated in FIG. 1 (a* value), FIG. 2 (ABS 420 nm) and FIG. 3 (PPO activity). The vertical axis (a*) in FIG. 1 illustrates spectrophotometer data expressed according to the L*a*b* method; a smaller a* value entails a greener color. In FIG. 2, a higher absorbance (larger Y-axis value) entails a browner color. In FIG. 3, a higher value of PPO activity (larger Y-axis value) entails a lower stability of the green color of the tobacco material.

The results of FIGS. 1 to 3 revealed that heating temperature, relative humidity and heating time are important in order to lower PPO activity without incurring a large drop in greenness of the tobacco leaf material, and that it is necessary to go through a predetermined heating time under conditions of temperature of 75° C. or higher and controlled relative humidity.

It was found that the higher relative humidity is, the faster the PPO activity drops. It was also found that PPO activity drops sufficiently if the heating time is made longer, even under a condition of low relative humidity.

Reference Example 2

Yellowing of Harvested Tobacco Leaves

Flue-cured (FCV) tobacco leaves that had been stored until the greater part of the leaf surface had turned yellow were measured using a colorimeter. As a result, the greenness (a* value) of the portion that turned yellow, which accounted for the greater part of the leaf surface, was 2.0±0.7. The a* value of the tobacco leaves when microwave-dried and made into a yellow tobacco material was 5.3±0.1, and the absorbance (ABS 420 nm) was 1.57.

Specifically, the tobacco leaves are referred to as "leaves having turned yellow" when the greater part of the tobacco leaf surface (60% or more of the surface area) has a greenness (a* value) larger than 1.0.

The enzyme activity value of tobacco leaves not having undergone the heating treatment of the present invention were 4.64 U/g (freeze-dried leaves of a Burley variety (Michinoku)) and 6.42 U/g (freeze-dried leaves of a Burley variety (Burley 21)).

The manufacturing method of the present invention allows thus obtaining a tobacco material in which a finish green color can be fixed stably, through further heating, under specific conditions, of a tobacco leaf material having had the a* value and moisture content thereof adjusted to a predetermined value or lower. The underlying mechanism herein is inactivation of the enzyme eliciting enzymatic browning (polyphenyl oxidase: PPO) contained in tobacco leaves.

INDUSTRIAL APPLICABILITY

In the tobacco material obtained through the manufacturing method of the present invention, the green color of the tobacco leaves is retained and the activity of the enzyme eliciting enzymatic browning is inactivated. Accordingly, an extract obtained through extraction of the tobacco material with water exhibits a light color, and it becomes possible to prevent coloring caused by seeping of an oral tobacco product in the oral cavity of the user when the latter consumes an oral tobacco product that uses the above tobacco material.

The invention claimed is:

1. A method for manufacturing a tobacco material, comprising: heating a tobacco leaf material having an a* value of 1.0 or less expressed according to the L*a*b* method and having a moisture content of 8 weight % or less, at a temperature of 75° C. or higher and in a humidity-controlled environment, such that said a* value is 1.0 or less and activity of an enzyme eliciting enzymatic browning is 0.1 U/g or less.

2. The manufacturing method of claim 1, wherein said humidity-controlled environment is an environment at 3% RH to 60% RH.

3. The manufacturing method of claim 1, wherein said humidity-controlled environment is an environment in which relative humidity is kept substantially constant between 3% RH and 60% RH.

4. The manufacturing method of claim 1, wherein the temperature in said step of heating is 99° C. or lower.

* * * * *